US010920503B2

(12) United States Patent
Schlappy et al.

(10) Patent No.: US 10,920,503 B2
(45) Date of Patent: Feb. 16, 2021

(54) OIL WELL CASING CENTRALIZING STANDOFF CONNECTOR AND ADAPTOR

(71) Applicant: UNIQUE MACHINE, LLC, Anchorage, AK (US)

(72) Inventors: Ronald Schlappy, Anchorage, AK (US); Chris Shumate, Anchorage, AK (US)

(73) Assignee: Unique Machine, LLC, Anchorage, AK (US)

( * ) Notice: Subject to any disclaimer, the term of this patent is extended or adjusted under 35 U.S.C. 154(b) by 0 days.

(21) Appl. No.: 16/374,352

(22) Filed: Apr. 3, 2019

(65) Prior Publication Data

US 2019/0301250 A1 Oct. 3, 2019

Related U.S. Application Data

(60) Provisional application No. 62/652,112, filed on Apr. 3, 2018.

(51) Int. Cl.

| | |
|---|---|
| ***E21B 17/10*** | (2006.01) |
| ***E21B 19/16*** | (2006.01) |
| ***E21B 17/042*** | (2006.01) |
| ***E21B 19/24*** | (2006.01) |

(52) U.S. Cl.
CPC ..... *E21B 17/1078* (2013.01); *E21B 17/042* (2013.01); *E21B 19/161* (2013.01); *E21B 19/24* (2013.01)

(58) Field of Classification Search
CPC ..... E21B 17/10; E21B 17/1078; E21B 19/24
See application file for complete search history.

(56) References Cited

U.S. PATENT DOCUMENTS

| | | | | |
|---|---|---|---|---|
| 4,275,935 | A * | 6/1981 | Thompson | E21B 7/04 175/325.7 |
| 4,877,092 | A | 10/1989 | Helm et al. | |
| 4,995,456 | A | 2/1991 | Cornette et al. | |
| 6,464,013 | B2 | 10/2002 | Bystedt | |
| 8,205,687 | B2 * | 6/2012 | Radford | E21B 17/1078 175/325.1 |
| 2002/0117307 | A1 | 8/2002 | Bystedt | |
| 2002/0139537 | A1 | 10/2002 | Young et al. | |
| 2003/0024707 | A1 | 2/2003 | Angman et al. | |
| 2013/0160993 | A1 | 6/2013 | Davila et al. | |

(Continued)

OTHER PUBLICATIONS

The International Searching Authority, International Search Report, dated Jul. 30, 2019.

(Continued)

*Primary Examiner* — Tara Schimpf
(74) *Attorney, Agent, or Firm* — Gottlieb, Rackman & Reisman, P.C.

(57) ABSTRACT

An improved centralizer is provided having a helical blade configuration with an improved geometry that reduces drag and friction forces as well as pressure build up as centralizers on strings are inserted into a borehole. An improved wrench adaptor is also presented that be customized to fit centralizers with varying designs by changing internal adapter rings and which is further configured to be easy to place over a centralizer and will lock in place relative to the centralizer blades when being rotated.

24 Claims, 13 Drawing Sheets

(56) References Cited

U.S. PATENT DOCUMENTS

2013/0292183 A1 11/2013 Eidem et al.
2018/0119499 A1* 5/2018 Zilka ..... E21B 17/1064

OTHER PUBLICATIONS

The International Searching Authority, Written Opinion of the International Searching Authority, dated Jul. 30, 2019.
Unique Machine,Cementralizer™ Specialty Centralization, Catalog, Jun. 15, 2006, Catalog CM010.

* cited by examiner

OIL WELL CASING CENTRALIZING STANDOFF CONNECTOR AND ADAPTOR

CROSS-REFERENCE TO RELATED APPLICATIONS

This application claims priority to U.S. Provisional Application No. 62/652,112 filed on Apr. 3, 2018, the entire contents of which is expressly incorporated by reference.

FIELD OF THE INVENTION

The present invention is related to casing and tubing string centralizers for use in drilling applications and for equipment for use in the installation of the same.

BACKGROUND

Casing and tubing strings are long connections of pipes used in drilling applications, such as for insertion into an existing borehole. Such strings are typically constructed from a series of threaded tubular sections joined to each other with a threaded coupler. There is a need make sure that the string is centered within the borehole. Centralization of the string helps to distribute stresses and forces within the system and allow fluids and other materials that are packed into the borehole so as to hold the string in place within it to be evenly distributed around the string. Various conventional centralizers exist to perform this function.

A conventional centralizer comprises a cylinder that is placed over the casing or tubing string at regular intervals and that has an arrangement of raised blades extending outward. Some centralizers can be slipped over the tube and are held in place with a locking collar, by crimping, or other method. Other conventional centralizers also function as the coupling used to join segments of casings or tubes together to form the string. This feature also fixes the centralizer in place along the string. One such type of centralizer design is disclosed in U.S. Pat. No. 6,464,013.

It is important that the centralizer evenly support the string on which it is placed. In one known configuration, straight blades are provided that run in an axial direction along the outside length of the centralizer. To provide adequate support of the centralizer and attached pipes, a relatively large number of blades are required, such as eight or more, with only narrow gaps between them. The large number of blades increases the weight of each centralizer and thereby the overall weight of the string, making it more difficult to advance and to rotate the string to during insertion into a borehole.

A more common centralizer arrangement uses helical blades that, in the aggregate, wrap entirely around the centralizer such that the leading edge of one blade overlaps the trailing edge of an adjacent blade. This arrangement allows use of fewer blades, such as three, while still providing at least one point of support at every place along the circumference of the centralizer.

The centralizers are typically installed on the string as the sections are joined together and before the string is inserted into a borehole. The outer diameter of the centralizer is often sized to be just slightly smaller than the inner diameter of the borehole/casing into which it is placed. A typical difference is about ¼ inch. The string insertion process often requires centralization, circulation of fluids to minimize pipe weight, and significant rotation and axial reciprocation of the casing and tubing within the bore hole to overcome the effects of friction and drag between the walls of the well caused by the pipe and pipe couplings to reach present well total depths.

It is desirable to be able to quickly insert the string into the borehole or other casing. However, obstructions along the outside surface of the string, and particularly the blades of the centralizers, block the flow of fluids over the string and cause pressure to build up as the string is inserted. If too much pressure builds up it can damage surrounding structures. As a result, insertion speed of the string must be slowed and back pressure bled off. This increases the time needed to install the string in the field and also adds additional steps to the process. The excess pressure problem can be exacerbated as the string is pushed in and out and rotated during the insertion process to allow it to advance and push past obstructions. The effects of friction and drag around the string can also make it more difficult to circulate fluids around the string after insertion and to distribute materials, such as gravel or sand, that help fix the string in place within borehole or casing.

A further drawback to conventional casing centralizer devices is that they provide limited or no protection to damage of liners, sand screens and isolation devices in some areas of the well during the running of casing and tubing during completion operations. Indeed, conventional centralizer blades themselves have sharp and abrupt edges and transitions along the outer surfaces. This can damage the surrounding structures, such as the interior walls of the casing, as the string is inserted and moved. This problem is exacerbated because the centralizer fits closely within the borehole.

When a centralizer is also serving as a coupler, it is joined to the adjacent pipes with a threaded connection. This requires turning the coupler and tightening it so that the connection is secure and well-sealed. When the blades on the centralizer extend along substantially its entire length, there is no place for a wrench to grab the centralizer to tighten it without damaging the blades. In some cases, workers may simply apply the wrench to the adjacent pipe while holding the centralizer in place by hand. This can result in leaks at the coupling and other problems.

One known solution is to provide a wrench adapter that fits over and surrounds the centralizer so that the centralizer, through the adapter, can be held with a wrench and tightened to the pipe. An adapter of this type is disclosed in the '013 patent. While such an adapter is functional, a significant drawback to this design is that it must be custom machined or molded to precisely match the specific centralizer design at issue. In practice, the length and diameter of the centralizer may vary for different applications. Similarly, the number of blades and their specific pitch and exterior contour can differ according to customer applications. As a result, an entirely new adapter of the '013 patent style must be fabricated for each variation in the specific centralizer design used.

SUMMARY

These and other problems are addressed by an improved centralizer and wrench adapter as disclosed herein.

Various embodiments of the improved centralizer have a helical blade configuration that reduces drag and friction forces. Increased blade height can be achieved along with reduced friction features to allow for easier string insertion. Various configurations provide improved exterior fluid flow characteristics that decrease pressure buildup as the string is inserted and moved. Aspects of the design reduce the risk of damage to surrounding structures, e.g., due to contact between the centralizer blades and the inner casing walls and also make it easier for the centralizer to be moved past potential obstructions without the blades catching on them. Additional benefits include the ability to use product material grade substantially identical to tubulars, the ability to maximize the total horizontal well depths without utilization of floating the pipe and well bore with fluid to minimize pipe weight. This allows the use of fluid activation devices that prevent migration of water, oil, and gas from around the string and well bore through expansion.

According to one aspect of the invention, a centralizer is provided with a helical blade configuration where the leading edge angles of the blades have a relatively steep angle and a two-stage transition from the leading surface of the coupler element to the top of the blade. According to a further aspect, blend radii are provided on the outer diameter of blades and that serve to minimize the friction when running the pipe laterally and where the pipe weight is supported on the outside of the helical blades. In yet another aspect, the outer diameter of the helical blades can have a curved transition area to reduce the possibility of the blades digging into the open well bore during pipe rotation operations and reduce required rotational torque when running in open drilled hole as compared to conventional configurations. In yet a further aspect, the helical blades are arranged so that there is a vertically aligned gap region between adjacent blades where the blades do not overlap allowing for improved fluid flow characteristics relative to conventional centralizers while still maintaining appropriate circumferential support and without increasing weight. The spacing and blades can be configured to provide a smooth vertical profile of the gap without abrupt angles that can increase friction due to turbulence.

According to a further aspect of the invention, an improved wrench adapter design is presented. The improved adapter has a main body and replaceable internal rings that can be configured for a particular centralizer design. The wrench adapter can easily be customized to fit centralizers with varying designs by changing the internal rings.

BRIEF DESCRIPTION OF THE FIGURES

These and other features and advantages of the invention, as well as structure and operation of various implementations of the invention, are disclosed in detail below with references to the accompanying drawings, in which.

DETAILED DESCRIPTION

A first centralizer configuration 10 is shown in FIGS. 1-7. The centralizer 10 as shown has three helical blades or ribs 20 formed on and extending outwards from the main surface 22. Fewer or more blades can be provided in alternative embodiments. Although not illustrated in this embodiment, the centralizer 10 can have interior threads to allow it to be used as a standoff centralizing coupler for tubes. The centralizer 10 can be manufactured as an integral part via molding, casting, machining, and/or other fabrication processes.

Figure 1:
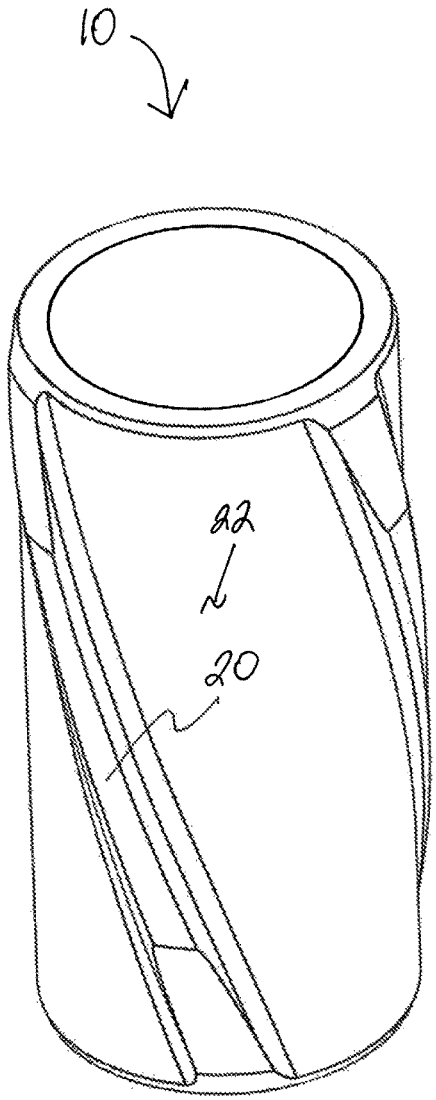
FIG. 1 is a perspective view of a first embodiment of a centralizing coupler.
Figure 2:
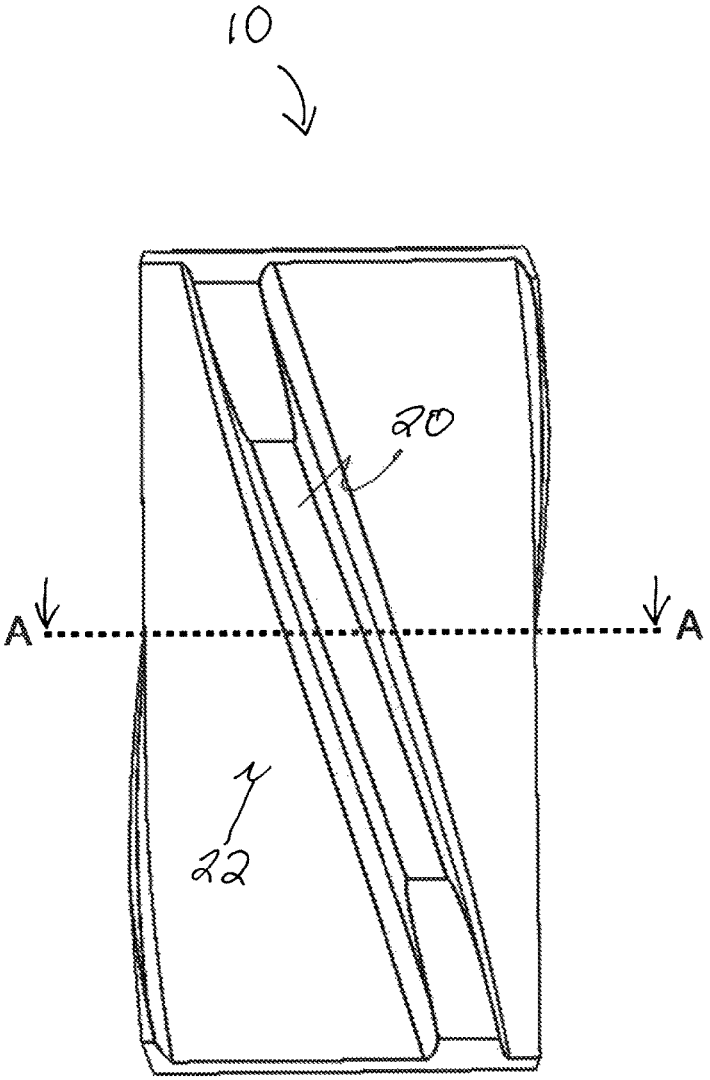
FIG. 2 is a side view of the first embodiment.
Figure 3:
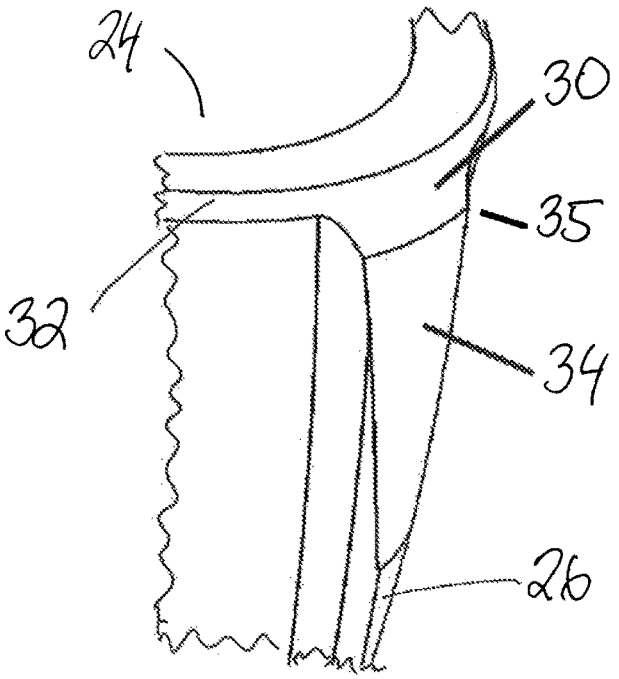
FIGS. 3 and 4 detail portions of the blade assembly of the first embodiment.
Figure 4:
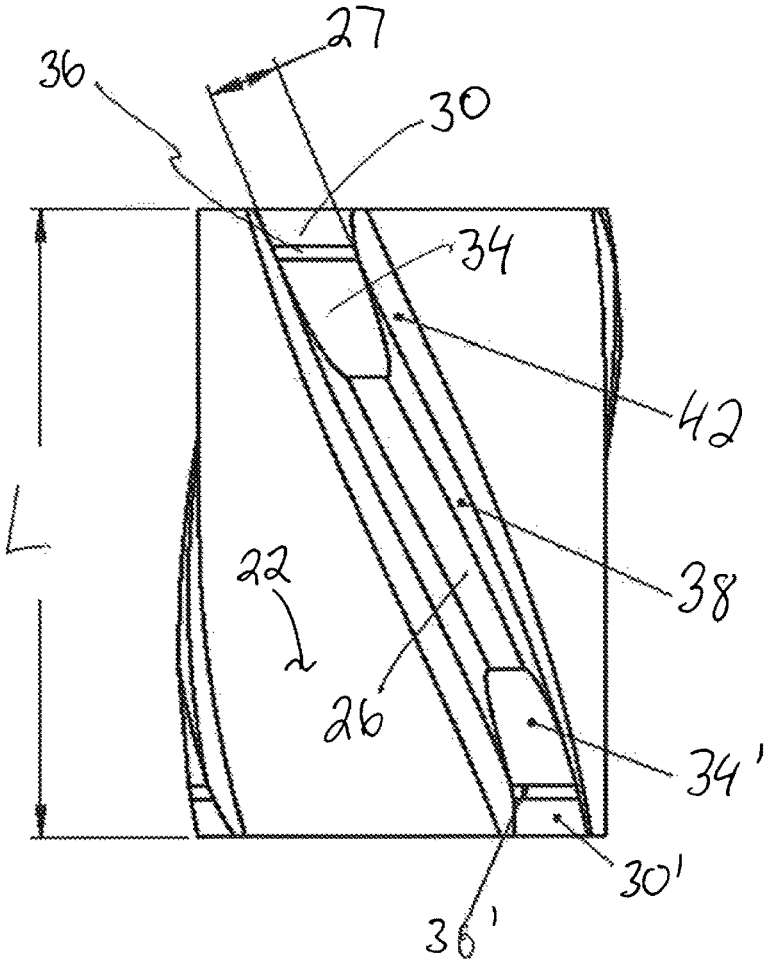

With reference to FIGS. 3 and 4, centralizer 10 has a multi-stage transition between the end 24 of the centralizer 10 to the top 26 of the blade 20. A leading surface 30 of a blade 20 is beveled with a first angle that is relatively steep, such as between 20 and 45 degrees. The beveled surface 30 can be an extension of a circumferential beveled edge 32 along the periphery of the end 24 of the centralizer 10 (FIG. 3). Leading surface 30 extends only partway to the top 26 of the blade 20 before transitioning into a second surface 34 with a shallower second angle less than the first angle and which angle can be much less than the first angle. Second surface 34 can continue to the top 26 of the blade 30. The bevel angle of second surface 34 can vary according to blade height and the overall connection length. In one configuration, the second angle is between about 2 and 5 degrees. In a particular configuration, leading surface 30 extends to a point where it is less than or equal to three-quarters of the maximum height 28 of the blade 20 over surface 22 (See FIG. 5) and second surface 34 has an angle that is shallow enough for the length of surface 34 along the rib 20 to be longer than a length of the leading surface 30 along the rib.

FIG. 3 shows an angled transition 35 between leading surface 30 and second surface 34. Alternatively, there can be a transition region 36 between surfaces 30 and 34 that is curved. In a particular configuration, the curve of the transition region 36 follows an arc having a radius minimum of about 1 inch for a typically sized centralizer blade. Because of the shallow second angle of the second surface 34, the particular nature of the transition between second surface 34 and the top 26 of the blade 20 has less of an impact; however, this transition may be rounded over if desired.

Advantageously, the two-stage transition, particularly when combined with a curved transition region 36 reduces friction when the centralizer 10 encounters well bore deviations and other obstacles as a string on which it is mounted is run into a hole. The configuration also allows the centralizer 10 to more easily and more smoothly ride over obstructions and deviations without catching. The configuration of the leading surfaces of the blades 22 can be the same on the front and back of the blade. A symmetrical arrangement means that the centralizer can be mounted in either direction. However, there may be circumstances when different geometries are suitable, e.g., were the configuration of trailing surfaces 30', 34' and transition 36' (FIG. 4) on a blade differs somewhat from the configuration of leading surfaces 30, 34, and transition 36.

The side of the blade 20 has a flat surface 38 between the blade's top surface 26 and the main surface 22 of the centralizer 10 and where, in various embodiments, at least the side surface 38 is angled so that top 26 of the blade 20 is narrower than the base and, more particularly, both sides surfaces 38 are angled so the blade cross section is generally trapezoidal. As shown most clearly in the cross-section of FIG. 6, there can be a curved transition region 40 between the side 38 of and the top 26 of the blade 20 to avoid an abrupt transition and reduce the likelihood that the centralizer 10 can damage an inner surface of a pipe casing as the pipe string bearing the centralizers is inserted, rotated, and removed. The transition region 42 between the side 38 of the blade and the surface 22 of the main centralizer tubing can also be curved. The curve of transition regions 40 and 42 can be relatively large when compared to the width 27 and/or height 28 of the blade 20. For example, the curve of regions 40 and 42 have an arc radius of between 1 to 1.5 inches for a blade 20 having a width varying between 1/inch and inch, e.g., an are radius that is from one and one-third to three times the blade width. The curved transition regions, and transition region 38 most specifically, helps reduces the risk of the centralizer causing damage to the interior of a casing within which it is positioned.

Figure 5:
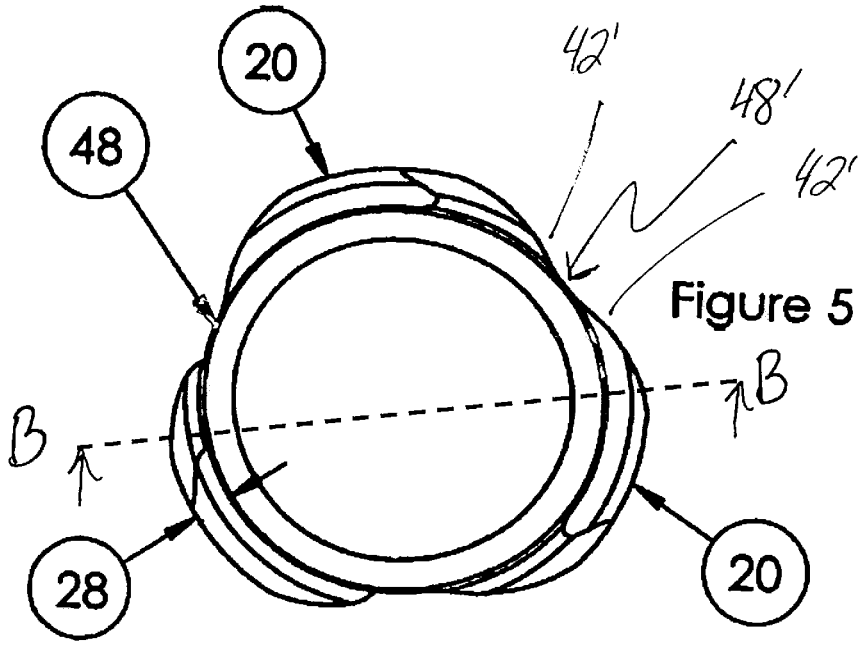
FIG. 5 is a top view of the first embodiment.
Figure 6:
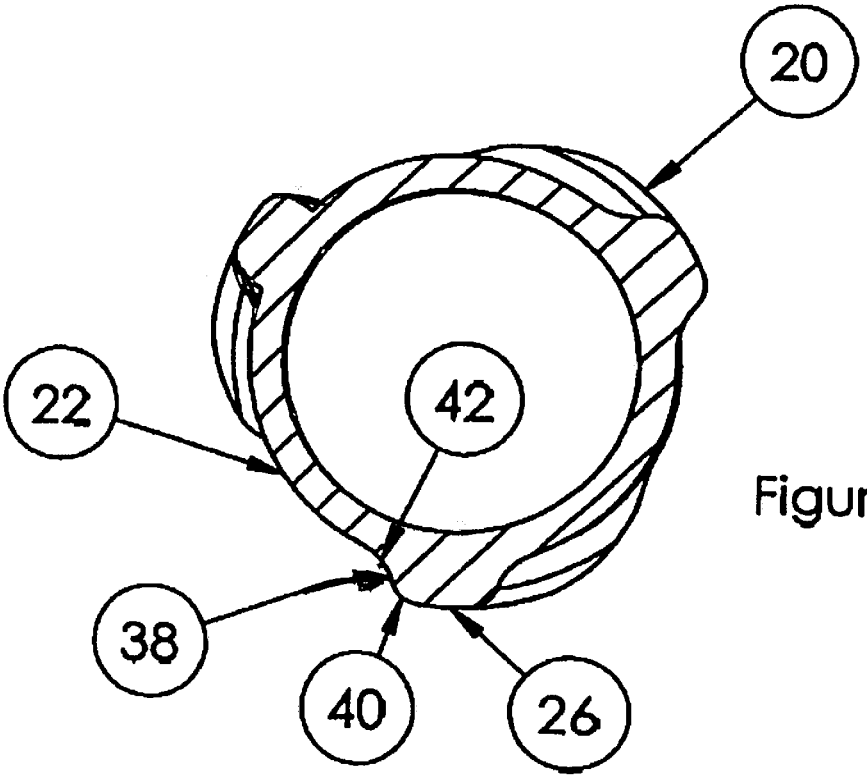
FIG. 6 is a cross-sectional view of the first embodiment along line A-A of FIG. 1.

According to a further feature, the blades 20 can be configured to provide improved fluid flow characteristics around the outside of the centralizer 10. As shown in this embodiment, the helical blades 20 run substantially the entire length L of the centralizer 10 with a particular helix angle. The helix angle can be selected so that the front 44 one blade does not overlap with the back 46 of an adjacent blade leaving a gap 48 on the surface 20 that provides a path along the surface of the centralizer from the front to the back along a line parallel to the central axis of the centralizer and within which fluid can flow straight along the length of the centralizer without encountering a blade. This is shown in FIG. 5 which is a top down view of the centralizer 10. The helical blades 20 are shown surrounding most of the centralizer. However, there is a gap 48 in which travel along the length of the centralizer can occur without intersecting a blade.

The helix configuration allows the centralizer to provide support around a large part of its circumference with a small number of blades while the linear gaps 48 provide a straight-through path for external fluids along the outside of the centralizer, thus reducing fluid flow friction and pressure buildup when the centralizer is moved forward and back. The particular helix angle selected is dependent on the number of blades, the length of the centralizer and the size of the gap desired.

In a typical configuration, the helix angle is 2 of the angle spacing between the helix and the length of the centralizer is short enough to allow the gap 48 to exist. Thus, for a 3 blade configuration, the blades are 120 degrees apart, the helix angle about is 60 degrees, and each rib has a length along the centralizer to cover an angular distance around the central axis of less than 120 degrees. As will be appreciated, depending on the overall front-to-back length of the blades on the centralizer, a steeper angle may be required to avoid overlap.

In a particular configuration, the angular spacing of the blades 20 and the transition area 42 between the sides 38 of the blades 20 and the surface 22 can be configured so that gap profile is smooth, e.g., the shape of the gap as viewed straight down the axis of the centralizer 10 has no sharp angled transitions. See, for example, gap 48' between the transition regions 42' of FIG. 5. In one arrangement, the gap region is continuously curved between the flat side 38 of the blades. The continuous curve can be entirely concave, such as where the gap 48 is narrow and the profile portions from the transitions 42 between the blade sides 38 meet in the middle of the gap. The gap profile can transition from concave in the transition 42 regions 42 smoothly to convex in the intervening surface area 22 back to concave at the opposing transition region 42. In a further arrangement, the continuous curve extends to the top surfaces 26 of the blades.

Figure 7:
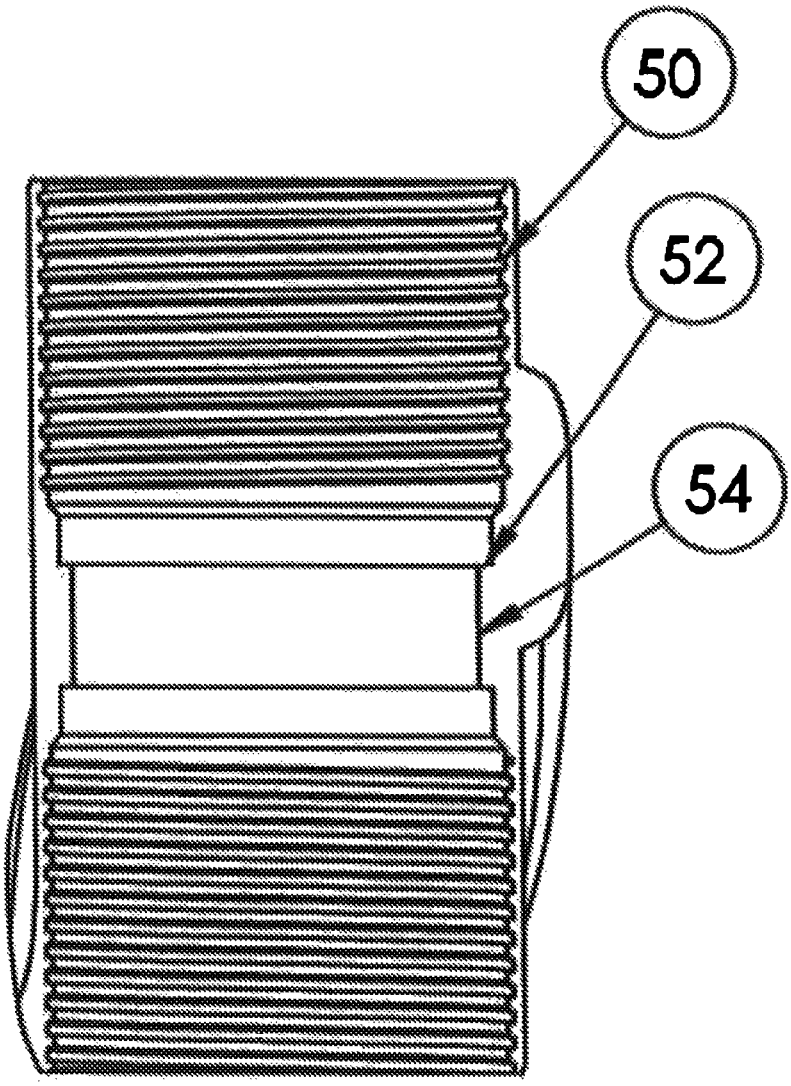
FIG. 7 is a cross-sectional view of the first embodiment along line B-B of FIG. 3.

FIG. 7 is an axial cross-section of the centralizer 10 along line B-B of FIG. 5. The cross-section shows the internal threads 50 that can be used to connect the centralizer 10 to a male threaded end of a pipe. When inserted, the pipe end will abut against ledge 52. In this configuration, a gap 54 will be formed between two pipes when attached to each end of the centralizer 10. The overall dimensions of the centralizer, such as its length, outer and inner diameters, the depth the threads extend within the centralizer and the size of the internal gap (or even absence) can be selected according to design requirements.

While the centralizer 10 as shown herein and in other embodiments is preferably threaded and serves as coupler, non-threaded versions that slip over the outside of a pipe can also be provided. To prevent these from sliding along the string as it is advanced, the centralizer can be secured in place along the pipe using conventional techniques.

Figure 8:
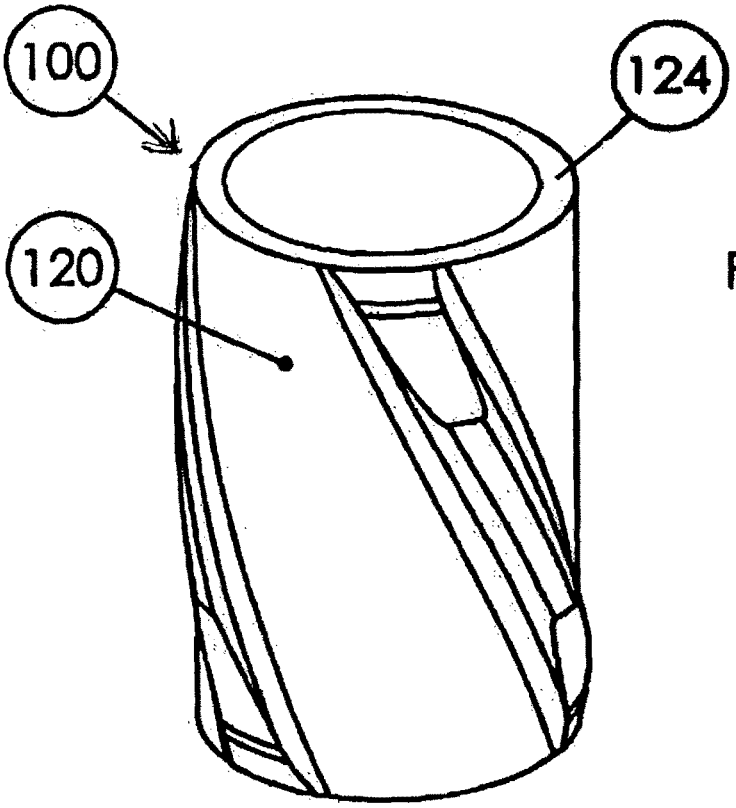
FIG. 8 is a perspective view of a second embodiment of a centralizer.
Figure 9:
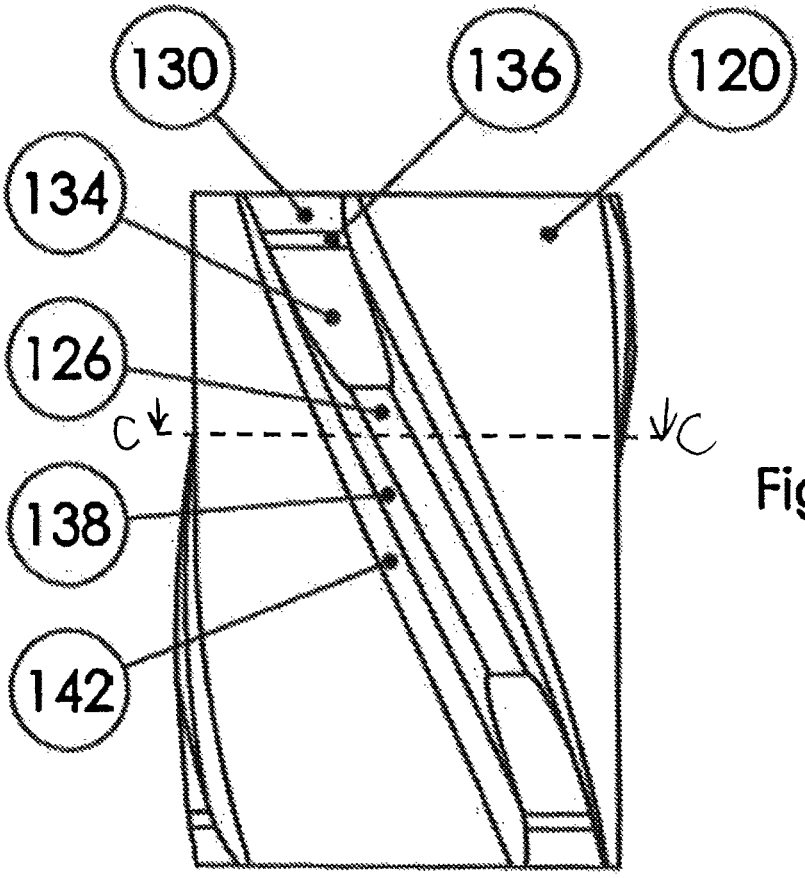
FIG. 9 is a side view of the second embodiment.
Figure 10:
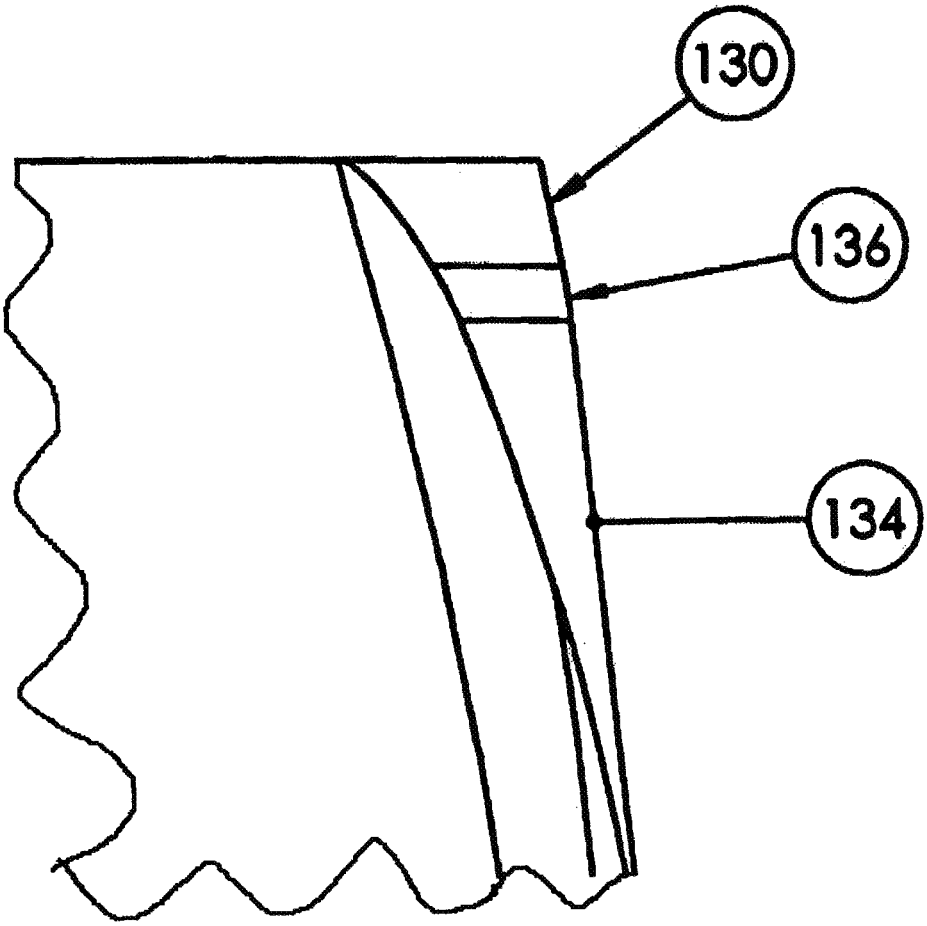
FIG. 10 details portions of the blade assembly of the second embodiment.
Figure 11:
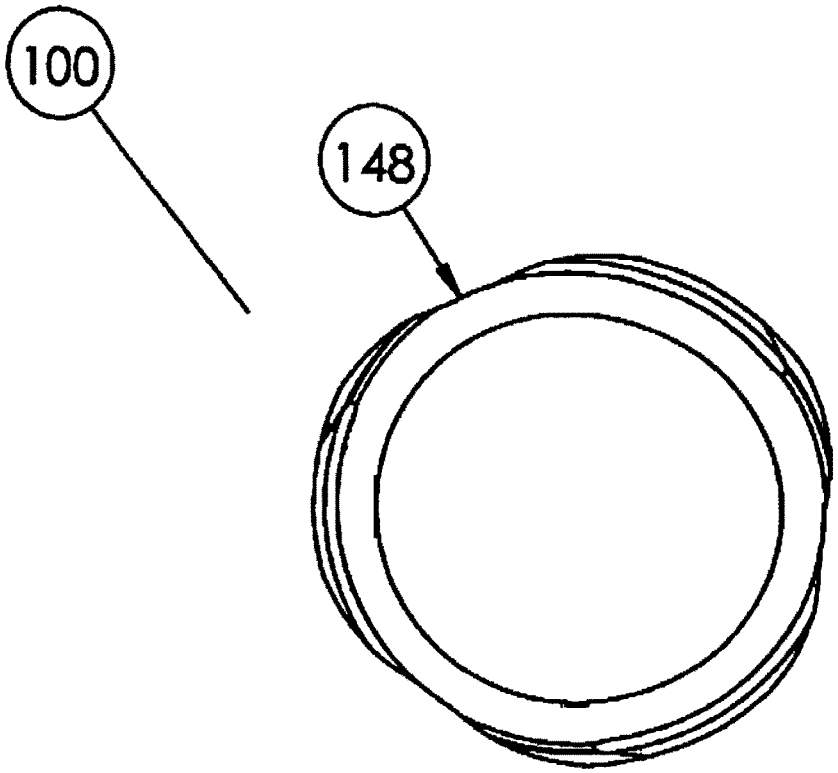
FIG. 11 is a top view of the second embodiment.
Figure 12:
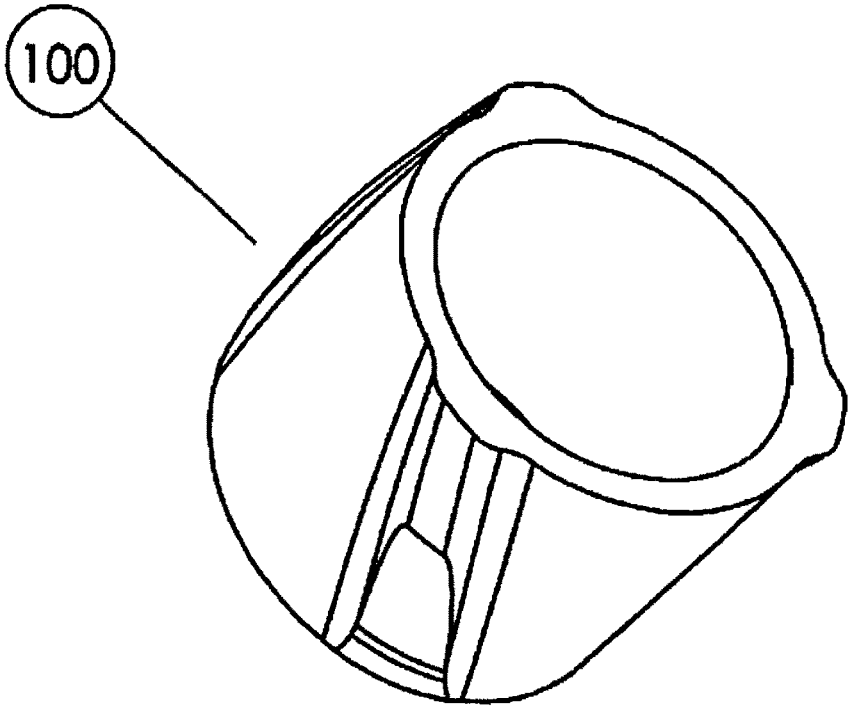
FIG. 12 is a cross-sectional view of the second embodiment along line C-C of FIG. 9.

A second embodiment of a centralizer 100 is shown in FIGS. 8-12. The configuration of centralizer 100 is similar to the configuration of centralizer 10 in the first embodiment but shorter in length. The blades 120 have similar two-stage transitions between a leading surface 130 having an intermediate curved transition region 136 to a second surface 134 that continues to the 126 of the blade 120. In this embodiment, and as shown in FIG. 8, the circumferential edge (edge 32 in the first embodiment) is omitted. Because this centralizer 100 is shorter, the helix angle of the blades 120 can be less while still providing support as well as a gap 148, permitting a straight-through path to reduce fluid flow friction and pressure buildup. The gap can have a non-angled gap profile as discussed above.

CTD liner run tests between a conventional centralizer marked as the Cementralizer™ and as disclosed in the '013 patent and the present embodiment used as a centralizing standoff connector and having and having a reduced helix angle on the blades, rounded edges, smoother profile, reduced friction factors by 6% for a 3.25" open hole size and 2% for a 4.25" hole size even though the overall flow area between the blades remained the same. In addition, the present design provided a substantially overall reduction in non-productive time due to liner running problems resulting from interaction of the centralizer with the inner liner, with NPT reduced from 18% historical rate to 3%.

Figure 13:
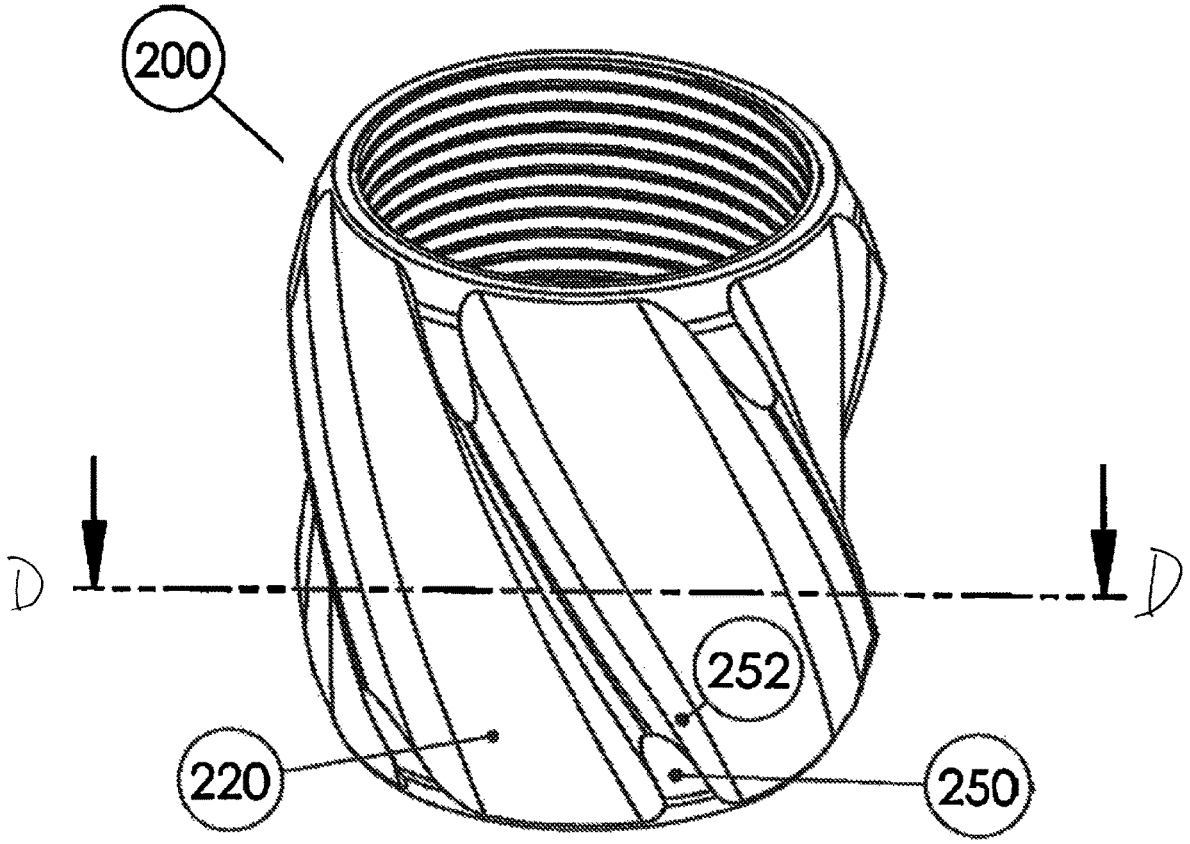
FIG. 13 is a perspective view of a third embodiment of a centralizer.
Figure 14:
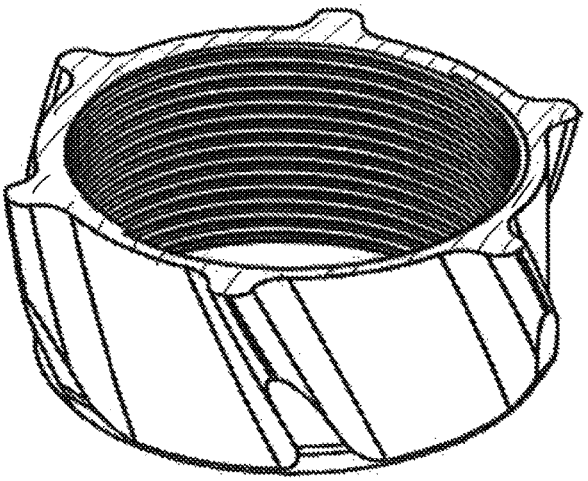
FIG. 14 is a cross-sectional view of the third embodiment along line D-D of FIG. 13.

FIGS. 13-14 show a third embodiment of a centralizer 200. This configuration is similar the first and second configurations but with six blades 220 blades. The blades 220 have the same basic two-stage and curved transition features as with respect to the first and second embodiments which provide advantages as discussed above. In this embodiment, adjacent blades 220 of centralizer 200 are not configured to have a flow gap but instead overlap.

Figure 15:
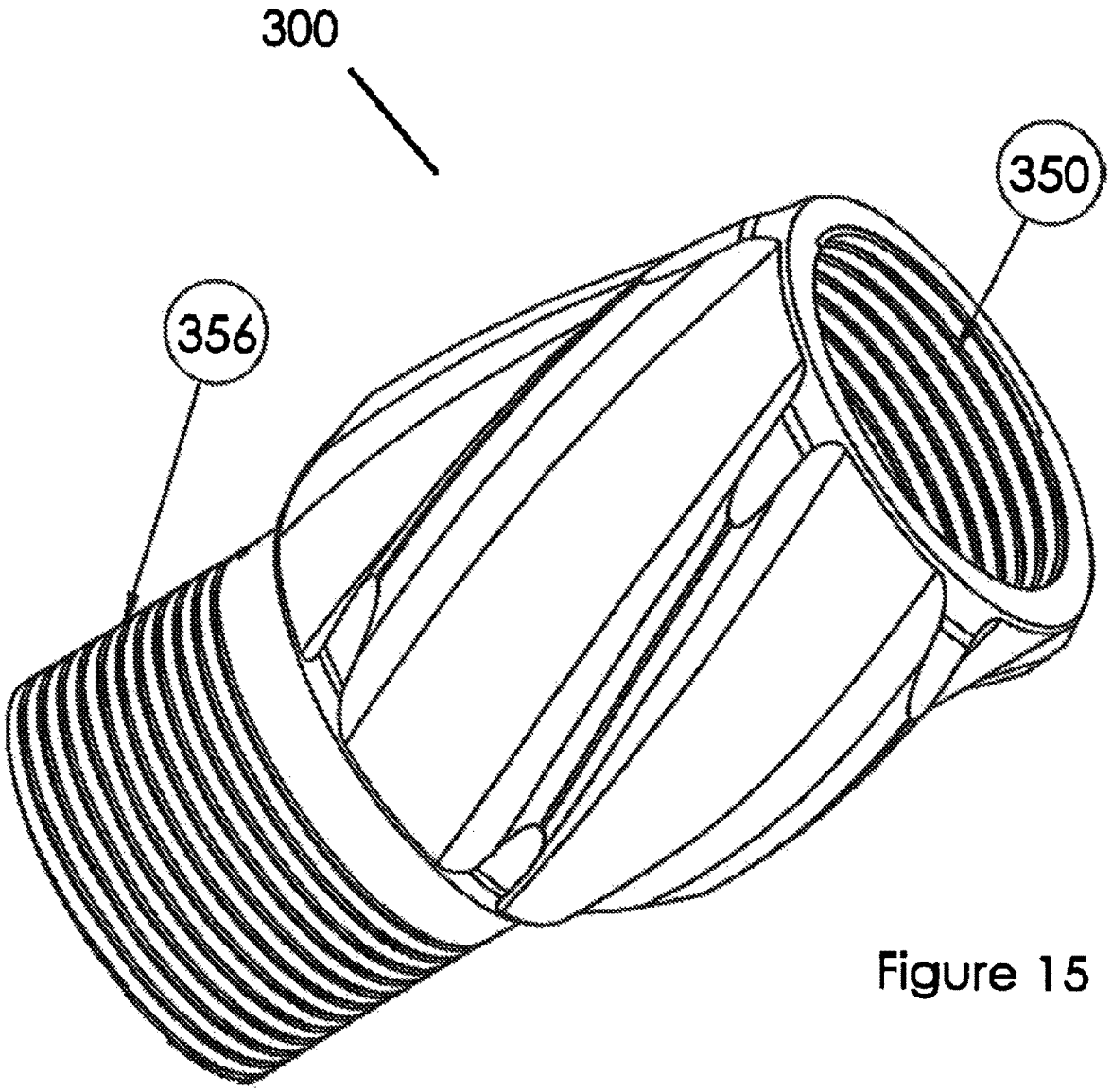
FIG. 15 is a perspective view of a fourth embodiment of a centralizer.

FIG. 15 shows a fourth embodiment of a centralizer 300 that that is similar to the third embodiment centralizer 200 but which also has a threaded male extension 356 on one end to allow for it to be coupled to corresponding threaded female portion in a pipe or other fixture. The opposite end has internal threads 350. Of course, both ends could have male extensions instead.

Bladed centralizers, such as the centralizer configurations illustrated above, and in many conventional versions as well have the blades extending along substantially the entire length of the unit. Because of this, there is no place to grab the centralizer with a wrench during installation without risking damage to the blades. An improved wrench adapter and components thereof are shown in FIGS. 16-21. The adapter design allows easy customization for centralizers having different geometric configurations, such as blade numbers and angle.

Figure 16:
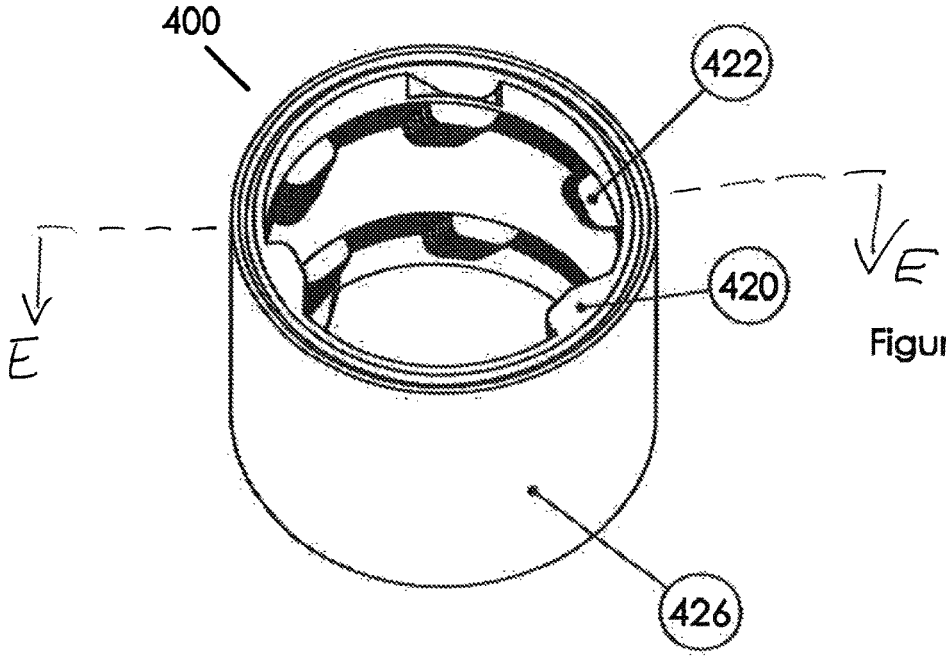
FIG. 16 is a perspective view of a wrench adapter for use with a centralizer.
Figure 17:
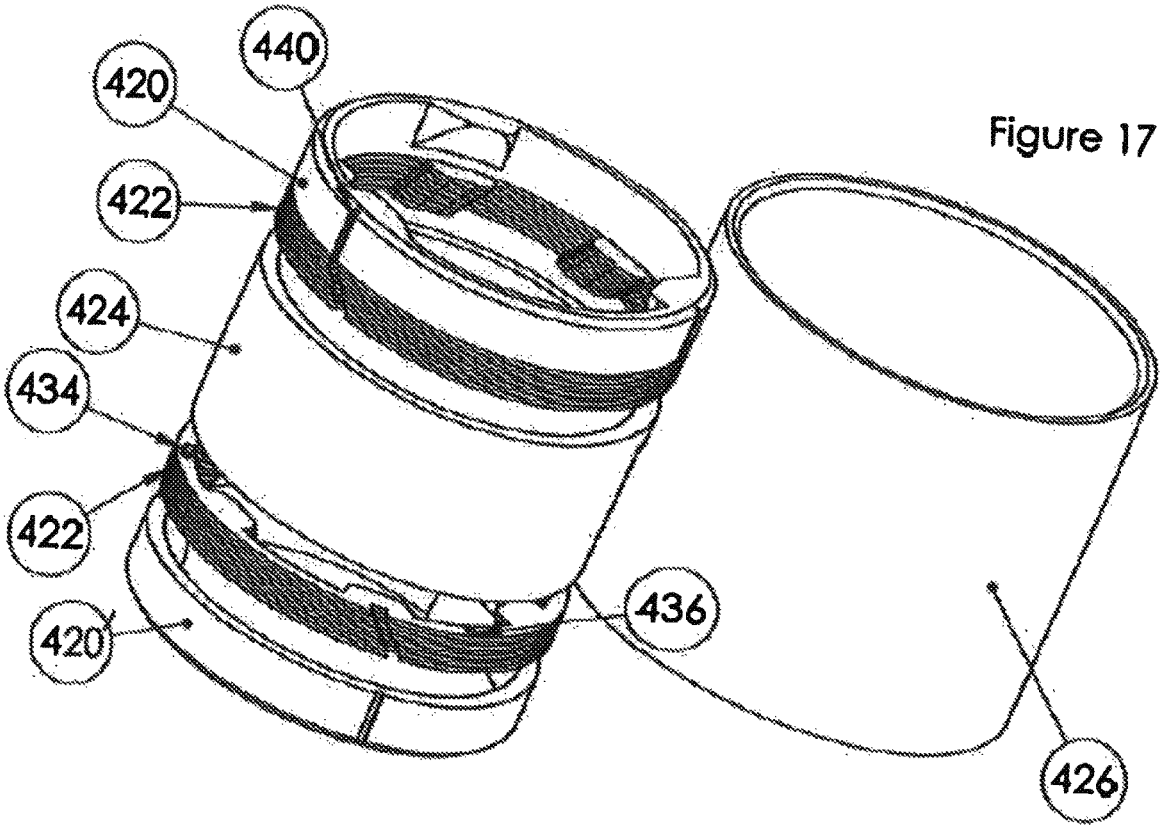
FIG. 17 is an exploded view of the adapter of FIG. 16.
Figure 18:
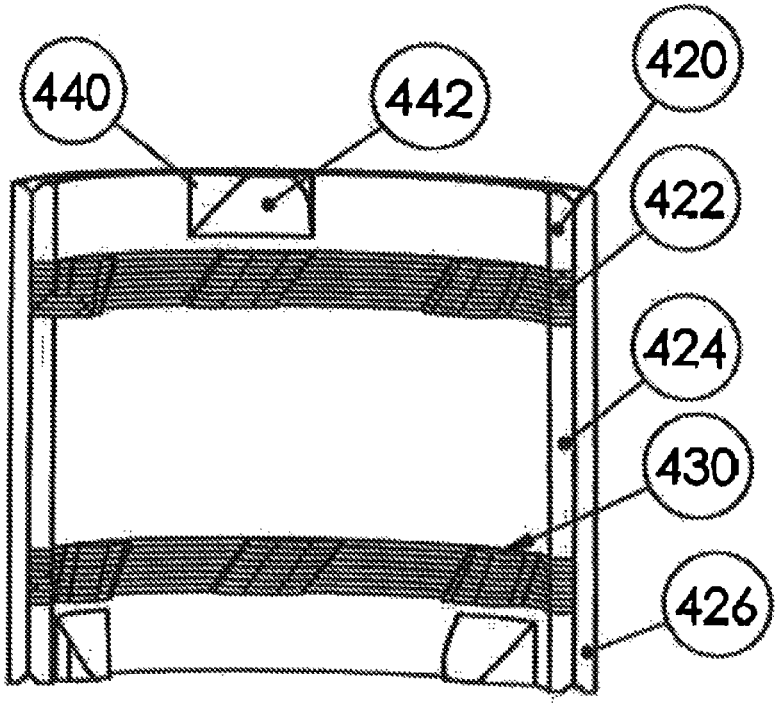
FIG. 18 is a cross-sectional view of the adapter of FIG. 16.

FIGS. 16 and 17 show a perspective and exploded view, respectively of an improved wrench adapter 400 that can be fitted over a bladed centralizer and that allows the use of a wrench to tighten the centralizer while avoiding damage to the blades. FIG. 18 is a vertical cross-section of the adapter 400 of FIG. 16 along line E-E. With reference to these figures, adapter 400 is comprised of outer rings 420, 420' with one or more adapter rings 422 in between. A central spacer ring 424 can also be provided. In the illustrated embodiment, a plurality of adapter rings 422 is sandwiched between the spacer ring 424 and each of the two outer rings 420, 420'. This stack is surrounded by an outer sleeve 426.

Figure 19:
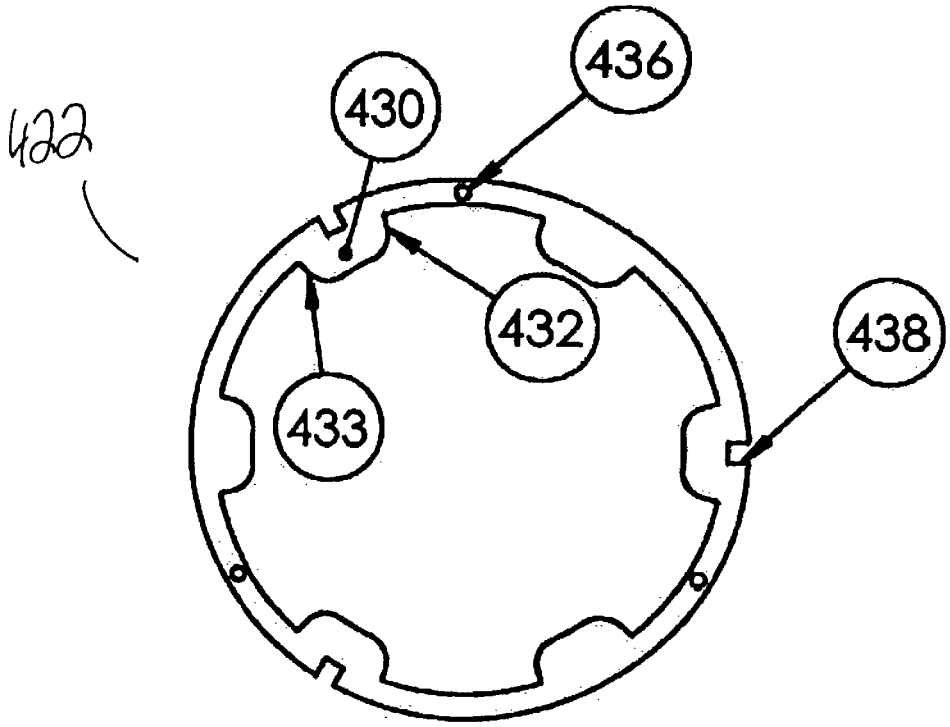
FIG. 19 is a top view of an adapter ring.
Figure 20:
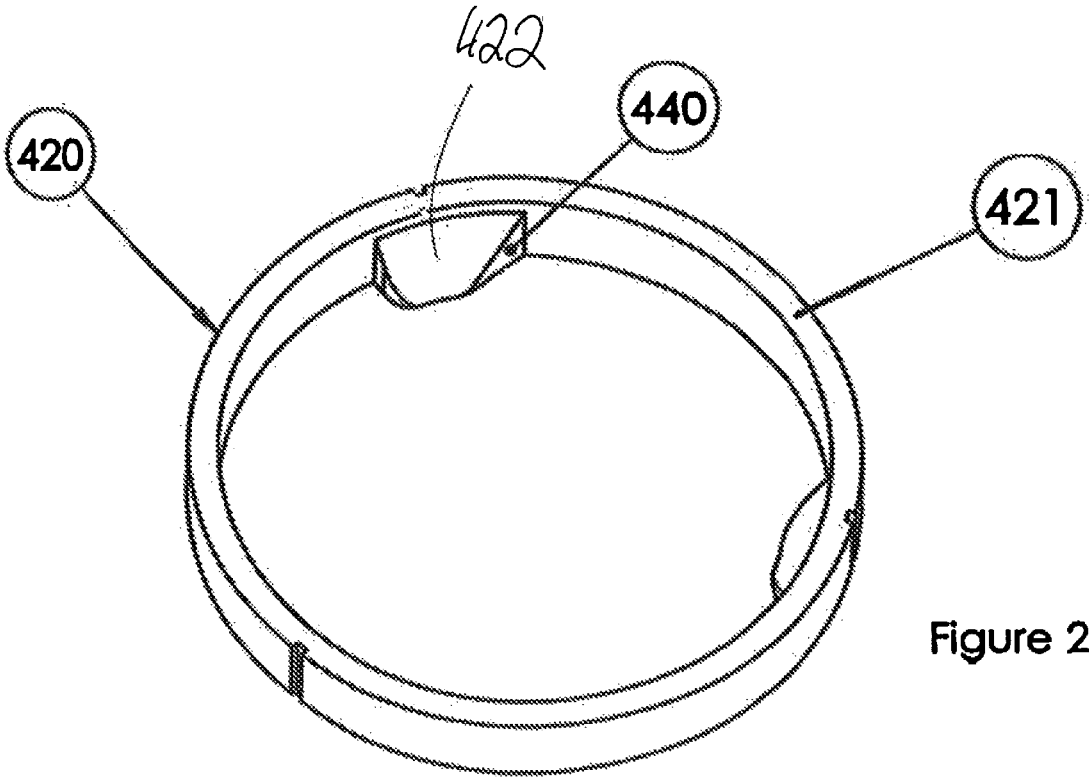
FIG. 20 is a bottom perspective view of an outer ring.
Figure 21:
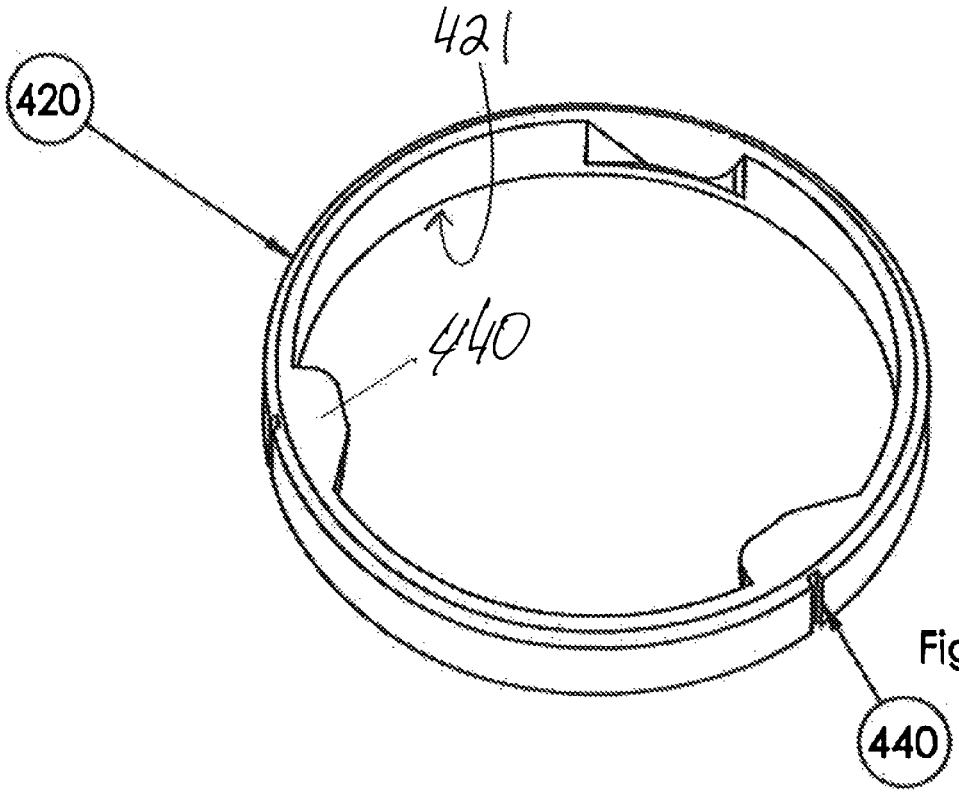
FIG. 21 is a top perspective view of an outer ring.

FIG. 19 is an illustration of exemplary adapter ring 422. FIG. 20 shows a perspective view of an exemplary outer ring 420 with the inside surface 421 (e.g., the surface facing the adapter rings) facing upwards. FIG. 21 shows a perspective view of an outer ring 420 with the surface 421 facing the adaptor rings facing downwards.

As shown in FIG. 19, the adapter rings 422 have a plurality of inwardly extending tabs 430. The tabs are spaced around adapter ring 422 in an arrangement corresponding with the spacing of at least two blades on the centralizer. Thus, for a centralizer with three blades spaced 120 degrees apart, the adapter rings can be provided with three tabs 430 also spaced 120 degrees apart.

The adapter 400 can be configured for different centralizer designs by selecting adapter rings 422 with appropriately configured and positioned tabs 430. The number of rings in the stack and the use of and length of the spacer ring 22 can be varied to accommodate shorter or longer centralizers. The number of tabs can be selected to correspond to the number of blades.

However, it is possible to use fewer tabs than blades, for example using two or three tabs for a centralizer with six blades.

Tabs 430 extend inward a distance slightly less than the height of the blades on the centralizer to which the adapter is fitted. Tabs have first and second edges 432, 433. One or both of the edges can be formed with an angle or contour that corresponds to the angle or contour of the side surface of the blades on the centralizer the adapter is to be used with. This allows the edge 432, 433 to smoothly abut against a respective side of a centralizer blade when the adapter is mounted on the centralizer.

A plurality of adapter rings 422 can be stacked in an offset manner as shown so that the angle formed by the offset tabs of the rings matches the helix angle of the centralizer blades. In one configuration a stack of adapter rings 422 is maintained in a fixed position by a post 434 that passes through holes 436 in the adapter ring and engages with e.g., corresponding opening or slot 434 on an outer ring 420 and in the spacer ring 424. When stacked, all parts are held rigidly together.

As will be appreciated, because the adapter rings 422 are offset, the holes 436 will be in different locations for different adapter rings in the stack where the post 434 is inserted vertically. Other mounting methods can also be used. For example several small pins or detents (not shown) can be formed on the adapter rings 422 and positioned to mate with a hole on an adjacent ring when the adjacent adapter rings are properly offset from each other. Multiple holes can be provided to allow for different offsets.

In a particular embodiment, the adapter rings 422 are thin rings made, e.g., from sheet steel and multiple rings are stacked together as illustrated. However, thicker rings can be used instead. Thus, one or only a few thick rings may be used. For a very thick ring, the tabs can be preconfigured with vertically angled side walls that correspond to the helix angle of the centralizer for which the adapter is to be used so that the tabs can abut smoothly against the blade side walls. The use of thin rings makes it easier to adjust the configuration of the tabs in the stack for use with different centralizers having different blade helix angles.

The assembled inner stack, comprising outer rings 420, adapter rings 422, and optionally a spacer ring 424 can be rotationally fixed within the outer sleeve 426 by providing one or more locking ridges formed along the interior of the outer sleeve (not shown) and which engage slots in the periphery of the inner stack, such as slots 438 on the adapter rings 422 and slots 440 on the outer rings 422 when the sleeve is placed over the slot. The opposite can also be used, wherein a slot is formed in the outer sleeve and a ridge extending radially outward from the outer rings and adapter rings configured to engage the slot when the adapter is assembled.

The inner stack can be assembled within the sleeve part-by-part or the sleeve fitted over a completely or partially assembled stack. Other means to fix the components in place, such as a locking screw, can be used instead.

Different centralizer configurations can be provided with custom outer sleeve 426 that has a locking ridge shaped to match the path of the centralizer blades at issue. The adapter can then be assembled using existing adapter rings, which rings will be guided by the locking ridge to the correct offset position. Outer sleeves 426 with different thicknesses can be provided to allow the wrench adaptor to couple to a specifically sized centralizer and then permit it to be grabbed with a bucking units, rig tongs, or casing tongs having different mouth sizes.

Advantageously, the adapter 400 can even be assembled or at least 'dry fit' around a sample of the centralizer for which it is to be used, even in the field. This helps ensure that the tabs and stops are positioned appropriately for the centralizer at issue. In some circumstances, the holes 436 in the rings and other parts can be spot welded and then drilled after the parts are assembled around a sample centralizer and a vertical post then inserted to secure the position.

As seen in FIGS. 18, 20 and 21, the outer rings 420 have one or more internal protruding stops 440. When the adapter is installed over a centralizer, the stops 440 and the tabs 430 can slide between the centralizer blades, thereby allowing the adaptor to be easily slipped onto the centralizer. When the adapter is positioned on the centralizer it can be turned either direction and will lock in place so it does not ride up or down along the helical blades. The stops 440 on the upper and lower outer rings 420 are offset relative to the tabs on the adjacent adapter ring 422 so that when the adapter 400 is turned a stop engages an end of a respective blade when the edges of the tabs contact the side of that blade. The stops 440 thus prevent the adapter from riding up or down along the helical blades as the adapter 440 is used to rotate the centralizer. Which end of the blade is engaged by a stop is dependent on whether the blades are helical clockwise or counterclockwise and which direction the adapter is turned. In a particular embodiment, there are the same number of stops on an outer ring as there are blades. However, fewer stops can be used. For example, a wrench adaptor for a six bladed centralizer can have two or three stops, preferably spaced symmetrically.

In a particular configuration, where the outer rings 420 are immediately adjacent to an adaptor ring 422, the stops 440 are offset from the tab 430 of the adjacent adapter ring 422 a distance generally equal to the blade with and in a direction opposite the helix direction of curvature. More generally, the tab position defines an axial path on the inside of the cylindrical stack and the adaptor ring 422 is offset from the point where path of the tabs intersects the outer rings.

The stops 440 in one embodiment have a size that generally matches the size of end of the blades. However, the stops could be different sizes. For example, a stop may be wider than the width of the blade.

Figure 22:
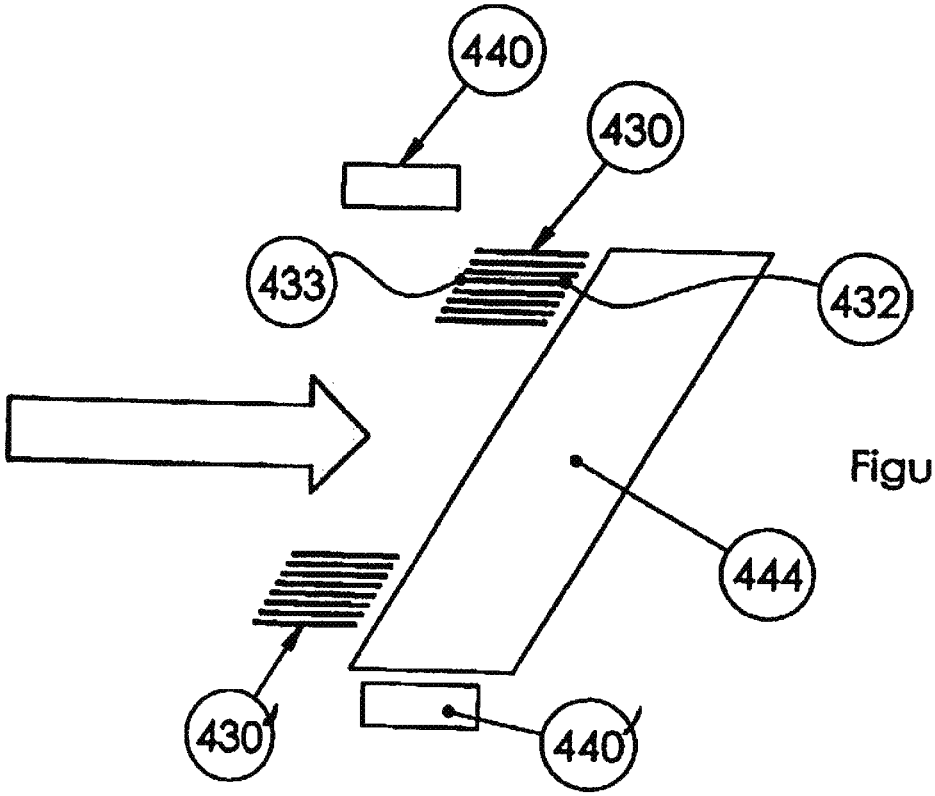
FIGS. 22 and 23 illustrate the interaction of the adapter tabs and stops with a centralizer blade.
Figure 23:
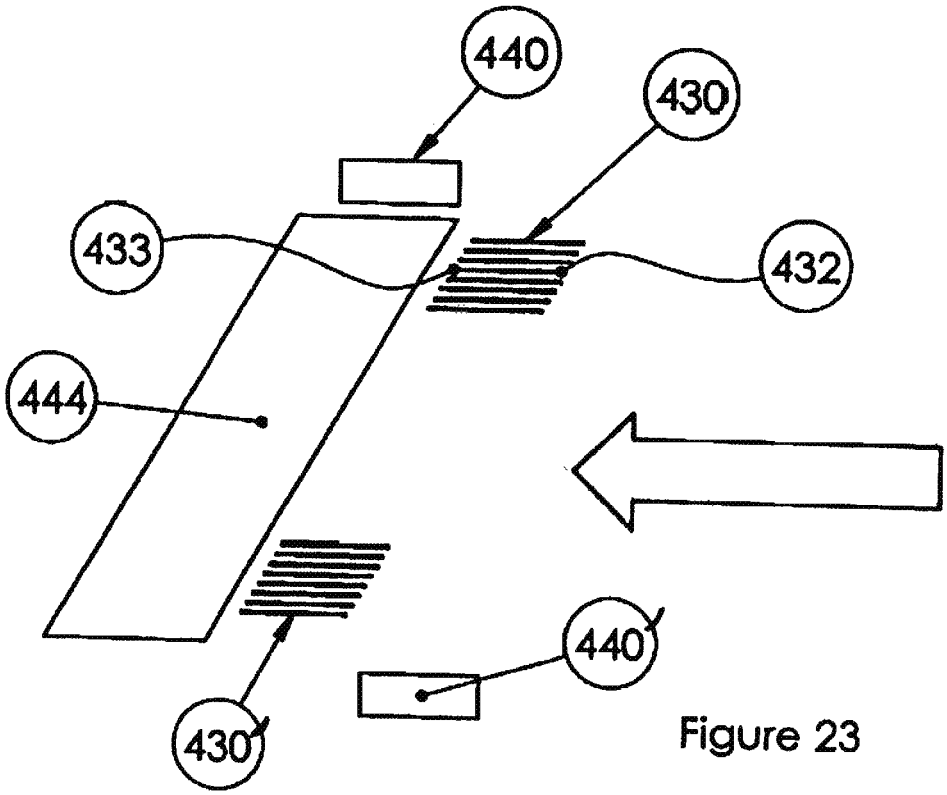

FIGS. 22 and 23 illustrate the interaction of upper and lower adapter tabs 430, 430' and upper and lower stops 440, 440' with a centralizer blade 444. With reference to FIG. 22, the bottom outer ring 420' (not shown) is positioned so that its stop 440' will engage the bottom end of blade 444 when the adapter is rotated to the right and surfaces 432 of adapter rings 422 engage the side of the blade 444. Stop 440' will prevent the adapter 400 from riding upwards along the blade 444. Similarly, and with reference to FIG. 23, the top outer ring 420 (not shown) is positioned so that its stop 440 will engage the front end of blade 444 when the adaptor is rotated to the left and surfaces 433 of adapter rings 422 engage the side of the blade 444. Stop 440 thus prevents the adapter 400 from riding downwards along the blade 444.

In the illustrated configuration, the stops 440 are generally pyramidal in shape with an inward facing surface 442 that is angled to correspond, e.g., with leading or trailing edge of the blade, as appropriate, such as the angle of beveled surface 30 on the blades of centralizer 10. Different geometric configurations of the stops can be used as appropriate to match the shape of the leading and trailing edges of the blade design for the centralizer for which is to be used.

The adapter 400 can be a solid cylinder as shown. In an alternative embodiment, the design can be split into halves (not shown) and provided with a hinge so it can be opened and closed around the pipe and centralizer. In this configuration, the interior stack halves can be physically joined to the outer sleeve halves so they remain in place when the adapter is opened. Various suitable connection methods will be known to those of skill in the art. For example, screws can be provided which pass through the outer sleeve to attach the end ring and spacers. The adapter rings themselves can be held in place by locking pins passing between the end ring and spacer components. In an alternative configuration, the outer surface of the end rings and/or spacers can be formed to engage the interior of the outer sleeve using a slot-in-groove construction, such as a T or dovetail. To assemble, the interior portion would be slid into place on each half of the outer ring.

The adapter 400 as illustrated herein is shown configured for use with a centralizer having helical blades and the shape of the tabs and the blades can be configured to match the centralizer of the first through fourth embodiments as set forth herein or configured to match other centralizer designs. The adapter rings 422 can be positioned to accommodate a wide variety of blade configurations. If the blades are straight, the adapter rings 422 can be arranged without any offset. If the blades are not symmetric along their length, differently configured adapter rings can be provided at different locations in the stack.

Various aspects and embodiments of the invention have been disclosed and described herein. Various modifications, additions and alterations may be made to the invention by one skilled in the art without departing from the spirit and scope of the invention.

The invention claimed is:

1. A pipe string centralizer comprising:

a cylindrical body having a front and a back and an outer surface; and a plurality of helical blades arranged around the body, extending radially outwards from the outer surface of the body, and having front and back ends defining a blade length, first and second sides defining a blade width, and a top surface defining a maximum blade height above the outer surface of the body;

each blade comprising a first bevel surface at the front end of the blade extending along the length of the blade at a first angle relative to the body and a second bevel surface at a second angle relative to the body and extending along the length of the blade between the first bevel surface and the top surface of the blade, the second angle being less than the first angle.

2. The centralizer of claim 1, wherein the first angle is between 20 and 45 degrees and the second angle is between 2 and 5 degrees.

3. The centralizer of claim 1, each respective blade further comprising a curved bevel transition region between the respective first bevel surface and the second bevel surface.

4. The centralizer of claim 3, wherein the respective bevel transition region between the first and second bevel surfaces follows an arc.

5. The centralizer of claim 1, wherein for a respective blade the first bevel surface extends a first distance along the length of the blade and the second bevel surface extends a second distance along the length of the blade, the second distance being greater than the first.

6. The centralizer of claim 1, wherein for a respective blade the transition between the first bevel surface and the second bevel surface is at a point outward from the outer surface an amount no more than three quarters of the maximum blade height.

7. The centralizer of claim 1, each respective blade further comprising first and second curved side transition regions between the top of the blade and a respective first surface on the first side and respective second surface on the second side.

8. The centralizer of claim 7, wherein there is a gap between the blades along a line on the outer surface from the front to the back of the body parallel to the central axis and that does not intersect any of the blades.

9. The centralizer of claim 1, wherein the first and second sides of each respective blade are tilted inwards towards each other such that the top surface of the respective blade is wider than the blade width along the outer surface.

10. The centralizer of claim 1, wherein a transition between each of the first and second sides and the top surface of each respective blade is curved.

11. The centralizer of claim 10, wherein a transition between each of the first and second sides and the outer surface of each respective blade is curved.

12. The centralizer of claim 1, further comprising internal threads inside the body at at least one of the front and the back and configured to receive a threaded end of a pipe.

13. The centralizer of claim 1, further comprising an externally threaded portion extending from one of the front and the back of the body.

14. A pipe string centralizer comprising:

a cylindrical body having front and back ends and an outer surface; and a plurality of helical blades arranged around the body, each blade extending radially outwards from the outer surface of the body, and having a front and a back, first and second sides, and a top surface;

each pair of adjacent blades having an intervening gap along a line on the outer surface from the front to the back of the body parallel to the central axis and that does not intersect either of the adjacent blades;

an axial surface profile of the gap between adjacent blades as viewed parallel to the central axis from the front end to the back end of the centralizer forming a continuous curve;

wherein when the centralizer is within the casing the gap provides a straight line fluid flow path between the outer surface of the centralizer and an inner surface of the casing.

15. The centralizer of claim 14, wherein the helical blades are symmetric and are symmetrically arranged around the body with an angular blade spacing between the blades, each blade extending over a circumferential angle less than the angular blade separation.

16. The centralizer of claim 15, wherein a helix angle of each blade is half of the angular blade spacing.

17. The centralizer of claim 14, each blade comprising a first bevel surface at the front end of the blade extending along the length of the blade at a first angle relative to the body and a second bevel surface at a second angle relative to the body and extending along the length of the blade between the first bevel surface and the top surface of the blade, the second angle being less than the first angle.

18. The centralizer of claim 17, each respective blade further comprising a curved bevel transition region between the respective first bevel surface and the second bevel surface.

19. The centralizer of claim 14, further comprising internal threads inside the body at at least one of the front and the back and configured to receive a threaded end of a pipe.

20. The centralizer of claim 14, further comprising an externally threaded portion extending from one of the front and the back of the body.

21. The centralizer of claim 14, wherein the axial surface profile forms a continuous concave curve.

22. The centralizer of claim 14, wherein the axial surface profile of the top surfaces of adjacent blades and including the facing sides of the adjacent blades and the gap between adjacent blades forms a continuous curve.

23. A pipe string centralizer comprising:

a cylindrical body having front and back ends and an outer surface; and a plurality of helical blades arranged around the body, each blade extending radially outwards from the outer surface of the body, and having a front and a back, first and second sides, and a top surface;

each pair of adjacent blades having an intervening gap along a line on the outer surface from the front to the back of the body parallel to the central axis and that does not intersect either of the adjacent blades;

each blade comprising a first bevel surface at the front end of the blade extending along the length of the blade at a first angle relative to the body and a second bevel surface at a second angle relative to the body and extending along the length of the blade between the first bevel surface and the top surface of the blade, the second angle being less than the first angle;

an axial surface profile of the gap between adjacent blades as viewed parallel to the central axis from the front end to the back end of the centralizer forming a continuous curve;

wherein when the centralizer is within the casing the gap provides a straight line fluid flow path between the outer surface of the centralizer and an inner surface of the casing.

24. The centralizer of claim 23, each respective blade further comprising a curved bevel transition region between the respective first bevel surface and the second bevel surface.

* * * * *